US006604790B2

(12) United States Patent
Murkey, Sr.

(10) Patent No.: US 6,604,790 B2
(45) Date of Patent: Aug. 12, 2003

(54) TANDEM MOVIE LOUNGE

(76) Inventor: Stanley L. Murkey, Sr., 3082 Detroit Cir. N., Jacksonville, FL (US) 32254

( * ) Notice: Subject to any disclaimer, the term of this patent is extended or adjusted under 35 U.S.C. 154(b) by 0 days.

(21) Appl. No.: 09/992,162

(22) Filed: Nov. 19, 2001

(65) Prior Publication Data

US 2003/0094839 A1 May 22, 2003

(51) Int. Cl.[7] ..... A47C 15/00
(52) U.S. Cl. ..... 297/243
(58) Field of Search ..... 297/293, 232, 297/188.14, 217.3, 69, 423.26, 188.19

(56) References Cited

U.S. PATENT DOCUMENTS 3,612,603 A * 10/1971 Snyder et al. ..... 297/243
4,225,183 A * 9/1980 Hanagan et al. ..... 297/243
4,735,456 A * 4/1988 Haefelfinger ..... 297/243

* cited by examiner

*Primary Examiner*—Peter R. Brown
(74) *Attorney, Agent, or Firm*—Michael I Kroll

(57) ABSTRACT

A chair has upper and a lower seating positions in tandem, such that the first occupant's legs encompass the second occupant in the lower seating position, whose head rests on the waist area of the first occupant. The second seating position is curvilinear or use in a normal, or reclined manner, and also has a removable backrest for insertion into holes between the first and second seats. Both seating positions are independently supported for one occupant use of the complete chair. The second seating position includes an extendable and retractable footrest, the extension operation being pneumatically assisted. A paper towel dispenser is attached proximate one or more armrests with door access for loading paper towels and storing miscellaneous items, the dispenser also having a top cavity for positioning a remote control. In another embodiment, the first seating position includes a reclining seat back, with the adjustment being pneumatically assisted.

31 Claims, 14 Drawing Sheets

TANDEM MOVIE LOUNGE

BACKGROUND OF THE INVENTION

1. Field of the Invention

The present invention relates generally to furniture and more specifically to a chair having an upper seating position and a lower seating position.

2. Description of the Prior Art

There are other tandem seating devices designed for seating two people. Typical of these is U.S. Pat. No. 157,144 issued to J. B. Wells on Nov. 24, 1874.

Another patent was issued to W. H. & C. Steinbrecher on Feb. 9, 1886 as U.S. Pat. No. 335,649. Yet another U.S. Pat. No. 1,807,077 was issued to C. A. Van Pappelendam on May 26, 1931 and still yet another was issued on Aug. 8, 1950 to G. H. Goldstein as U.S. Pat. No. 2,517,785.

Another patent was issued to H. P. Glass on Feb. 15, 1966 as U.S. Pat. No. 3,235,304. Yet another U.S. Pat. No. 3,776,353 was issued to Edward Roth on Dec. 4, 1973. Another was issued to Nelson Lothair Cecil on Jan. 31, 1978 as U.S. Pat. No. 4,071,276 and still yet another was issued on Dec. 15, 1998 to Steven M. Kirby as U.S. Pat. No. 5,848,821.

Another patent was issued to James Sproule on Jul. 18, 2000 as U.S. Pat. No. 6,089,660. Yet another U.S. Pat. No. 6,089,663 was issued to Peter C. Hill on Jul. 18, 2000.

U.S. Pat. No. 157,144

Inventor: J. B. Wells

Issued: Nov. 24, 1874

The body of a buggy or similar vehicle is mounted on two side bars, in such a manner that it can be moved forward or backward and secured in either position whereby one or two seats can be used at pleasure.

U.S. Pat. No. 335,649

Inventor: W. H. & C. Steinbrecher

Issued: Feb. 9, 1886

In combination with the body of a sleigh, a seat mounted thereon having a central longitudinal division, one part adapted to be moved rearward over the back of the box, the other part adapted to be moved forward each other, joining as a single seat. The front seat back is detachable.

U.S. Pat. No. 1,807,077

Inventor: C. A. Van Pappelendam

Issued: May 26, 1931

In a vehicle having a frame supported on front and rear wheels, the combination of means for mounting a plurality of seats upon said frame, a hinge connection between the seats, and means cooperating with said hinge connection for rigidly connecting the seats.

U.S. Pat. No. 2,517,785

Inventor: G. H. Goldstein

Issued: Aug. 8, 1950

A Stroller having a combined seat and principal chassis portion wherein the latter extends materially beyond the upright back of said seat and spaced handle members extending upwardly and backwardly from said extension forming an open area intermediate of the upper extremity of said seat back and said handle members, and a removable upper seat portion installed within said otherwise open area and supported upon the back of said lower seat and said handle members in a manner to make available said rearmost chassis extension as a footrest for an occupant of said second seat.

U.S. Pat. No. 3,235,304

Inventor: H. P. Glass

Issued: Feb. 15, 1966

In a collapsible reclining chair, in combination, a base comprising two pairs of legs, each pair of legs comprising two legs pivotally connected together at one end to provide an apex, a bracket for connecting the two legs in each pair, said bracket comprising two portions each portion pivotally connected to the other at one of its ends and pivotally connected to one leg at its other end, a body supporting portion comprising two sections pivotally connected together, a pair of flexible straps for pivotally supporting said body supporting portion on said base, each strap being located on a side of said body supporting portion and connected to one section thereof at each of its ends, each of said straps being adapted to overlie an apex on said base, at least one flexible driven member having each of its ends connected to one section of said body supporting portion, a shaft serving as a pivot for the said two portions of said bracket and rotatable with respect thereto a rotatable member rigidly mounted on said shaft for driving said flexible driven member, a crank for effecting rotation of said rotatable member, and means on said crank for cooperation with indexing means on one portion of said bracket.

U.S. Pat. No. 3,776,353

Inventor: Edward Roth

Issued: Dec. 4, 1973

A motor vehicle having two speed rear wheels a single centered front wheel mounted front wheel for steering movement, with the frame and body of the device having relatively wide rear portions between the two wheels carrying and enclosing a driving motor, and having narrower forwardly projecting portions carrying a driver's seat at a location at which the driver's legs straddle those portions, with the forwardly projecting portion of the frame extending upwardly toward its forward end to connect pivotally to a fork mounting the front wheel. A second seat is desirably located back of and at a level higher than the driver's seat, with the driver's seat preferably being located lower than, and the second seat preferably being located higher than, the level of the tops of the rims of the rear wheels.

U.S. Pat. No. 4,071,276

Inventor: Nelson Lothair Cecil

Issued: Jan. 31, 1978

Improvements in a rocker recliner chair which permit the backrest to be moved to an initial, relatively slight reclining position without having to first extend the footrest from retracted to extended position, however, in order to continue to move the backrest into an advanced or full recline position, the footrest must be extended which is effected through a manually operated handle connected to the footrest linkage. The foregoing sequencing and control is achieved by a linkage interconnecting the footrest linkage and the linkage which serves to mount the seat relative to the base which, in the preferred embodiment of the invention, includes a rocker frame.

U.S. Pat. No. 5,848,821

Inventor: Steven M. Kirby

Issued: Dec. 15, 1998

An improved double recliner having a load distributing platform base member. The planar load distributing platform prevents the individual components from torquing in relation to one another as one end of the double recliner is lifted by providing single unitary load distributing base for the individual components. The improved double recliner has two recliner rockers with a centrally disposed console placed between the two recliner rockers. The planar platform carries recliner bases that are secured to the platform in selected positions and the recliners are mounted upon, and secured to, the recliner bases thus forming a single unit of furniture.

U.S. Pat. No. 6,089,660

Inventor: James Sproule

Issued: Jul. 18, 2000

A sectional sofa having one sofa section that includes a pair of reclining seats that are separated by a console on which push button controls are mounted that separately control the movement of the reclining seats from the upright to the reclined positions.

U.S. Pat. No. 6,089,663

Inventor: Peter C. Hill

Issued: Jul. 18, 2000

An accessory chair apparatus for use with video games, the apparatus comprising a concave base, a seat portion, and a console. The base is shaped so as to facilitate a rocking motion in both a front to back and a side to side direction. However, body stabilizers may also be deployed as to prevent such rocking. The seat portion may include a back portion upon which a headrest may be adjustably mounted. The headrest may include at least one audio speaker mounted therein to enhance the game playing experience. The console is adjustably mounted on the front end of the base so as to ensure comfortable seating for occupants of various sizes. Also, a controller mounted frame may be placed on the console so as to accept a game controller, such as, for example, a steering wheel. The apparatus may also include a variety of storage compartments such as a basket, a case, and recesses in the body and the case.

While these tandem seats may be suitable for the purposes for which they were designed, they would not be as suitable for the purposes of the present invention, as hereinafter described.

SUMMARY OF THE PRESENT INVENTION

A primary object of the present invention is to provide a chair that provides both upper and lower seating in tandem.

Yet another object of the present invention is to provide a pop up footrest for the lower seating position.

Still yet another object of the present invention is to provide a reclining backrest for the upper seating position.

Another object of the present invention is to provide a food/beverage receptacle.

Yet another object of the present invention is to provide an optional backrest for the lower seating to provide back support to a person sitting in the lower seating area.

Still yet another object of the present invention is to provide operating handles to control the pop up footrest and optional reclining backrest.

Another object of the present invention is to provide a receptacle for a remote control to control a television or VCR.

Yet another object of the present invention is to provide a paper towel dispenser to allow one to have access to paper towels to clean ones face or hands.

Additional objects of the present invention will appear as the description proceeds The present invention overcomes the shortcomings of the prior art by providing a chair having an upper and lower seating element wherein two people can sit in tandem within said chair. The lower seating section has an extendable retractable footrest with a control mechanism position on the exterior side wall of the chair. Also provided is an insertable, removable head and neck support having posts for insertion into holes between the upper and lower seats.

The upper seating section armrest has a cavity therein for the storage of an electronic remote control mechanism and an attached housing member for the storage and dispensing of paper towels. Also the upper and lower seating sections are equipped with food and beverage receptacles.

A chair for two occupants in tandem is provided, comprising: (1) a first seat assembly having: a seat portion having a front edge; a structure independently supporting the seat portion; and a seat back portion; and (2) a second seat assembly having: a curved seat portion extending downwardly and forwardly from the first seat assembly seat portion front portion, the curved seat portion having a front portion; a curved seat portion supporting structure independently supporting the curved seat portion; and a footrest extending from the curved seat portion front portion, the footrest being movable between a first position that is substantially vertical and a second position that is substantially horizontal.

In another embodiment, the chair further comprises a handle and linkage, the linkage being attached to the handle and the footrest, such that movement of the handle in a first direction forces the footrest from its first to its second position, and movement of the handle in a second direction forces the footrest from its second to its first position.

In another embodiment, the chair further comprises a hydraulic lift assembly attached to the footrest linkage such that the movement of the footrest from the first position to the second position is assisted.

In another embodiment the seat back portion is reclinable relative to the first seat portion.

In another embodiment, the first seat assembly seat back portion is hingedly attached to the first seat assembly seat portion.

In another embodiment, the chair further comprises a multi-position hinge assembly for hingedly attaching the first seat assembly seat back portion to the first seat assembly seat portion, such that the seat back portion may be positioned at varying angles to the seat portion.

In another embodiment, the chair further comprises a handle and linkage, the linkage being attached to the handle and the multi-position recliner assembly, such that movement of the handle in a first direction releases the multi-position recliner assembly for adjustment, and movement of the handle in a second direction locks the multi-position recliner assembly, preventing additional adjustment.

In another embodiment, the chair further comprises a hydraulic lift assembly attached to the seat back portion such that the movement of the seat back portion to a more vertical position is assisted.

In another embodiment, the second seat assembly further comprises a removable backrest, the backrest being attachable proximate the first seat assembly seat portion front portion.

In another embodiment, the removable backrest is sized for positioning between the legs of the occupant seated on the first seat assembly seat portion, the occupant's feet remaining on the second seat assembly curved portion.

In another embodiment, rises the first seat assembly further comprises at least one armrest.

In another embodiment, the chair further a paper towel dispenser attached proximate the armrest.

In another embodiment, the paper towel dispenser further comprises a cavity for storage of an electronic remote control unit.

In another embodiment, the paper towel dispenser has an interior, a door for inserting the paper towel roll into the paper towel dispenser interior, and a slot for feeding the paper towels from the paper towel dispenser interior.

In another embodiment, the chair further comprises a food receptacle attached proximate the armrest.

In another embodiment, the chair further a drink receptacle attached proximate the arm rest.

In another embodiment, the chair further comprises a food and drink receptacle attached proximate the armrest.

In another embodiment, the second seat assembly further comprises at least one armrest.

In another embodiment, the chair further comprises a paper towel dispenser attached proximate the armrest.

In another embodiment, the paper towel dispenser further comprises a cavity for storage of an electronic remote control unit.

In another embodiment, the paper towel dispenser has an interior, a door for inserting the paper towel roll into the paper towel dispenser interior, and a slot for feeding the paper towels from the paper towel dispenser interior.

In another embodiment, the chair further comprises a food receptacle attached proximate the armrest.

In another embodiment, the chair further a drink receptacle attached proximate the armrest.

In another embodiment, the chair further comprises a food and drink receptacle attached proximate the armrest.

In another embodiment, the first seat assembly and second seat assembly may be separated and rejoined.

In another embodiment, a chair is provided for two occupants in tandem, that comprises: means for seating the first occupant, said means having a first seat; and means for seating the second occupant, said means having a second seat, said means including means for supporting the second occupant's feet, said means for supporting the second occupant's feet including an extendable and retractable footrest; said means for seating a first occupant including means for supporting the seated first occupant when the second seat is unoccupied, and said means for seating a second occupant including means for supporting the seated second occupant when the first seat is unoccupied.

In another embodiment, the means for seating the second occupant further comprises means for supporting the back and head of the second occupant, said means being removably attached.

In another embodiment, the chair further comprises means for holding food and beverages.

In another embodiment, the chair further comprises means for accessing and storing paper towels.

In another embodiment, the chair further comprises means for accessing and storing an electronic remote control.

In another embodiment, the means for seating the first occupant further comprises a seat back and means for adjusting the seat back angle relative to the first seat.

The foregoing and other objects and advantages will appear from the description to follow. In the description reference is made to the accompanying drawing, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

Also shown is the backrest operating handle in the closed position. The lower handle controls the footrest. The upper handle controls the reclining backrest.

Figure 9:
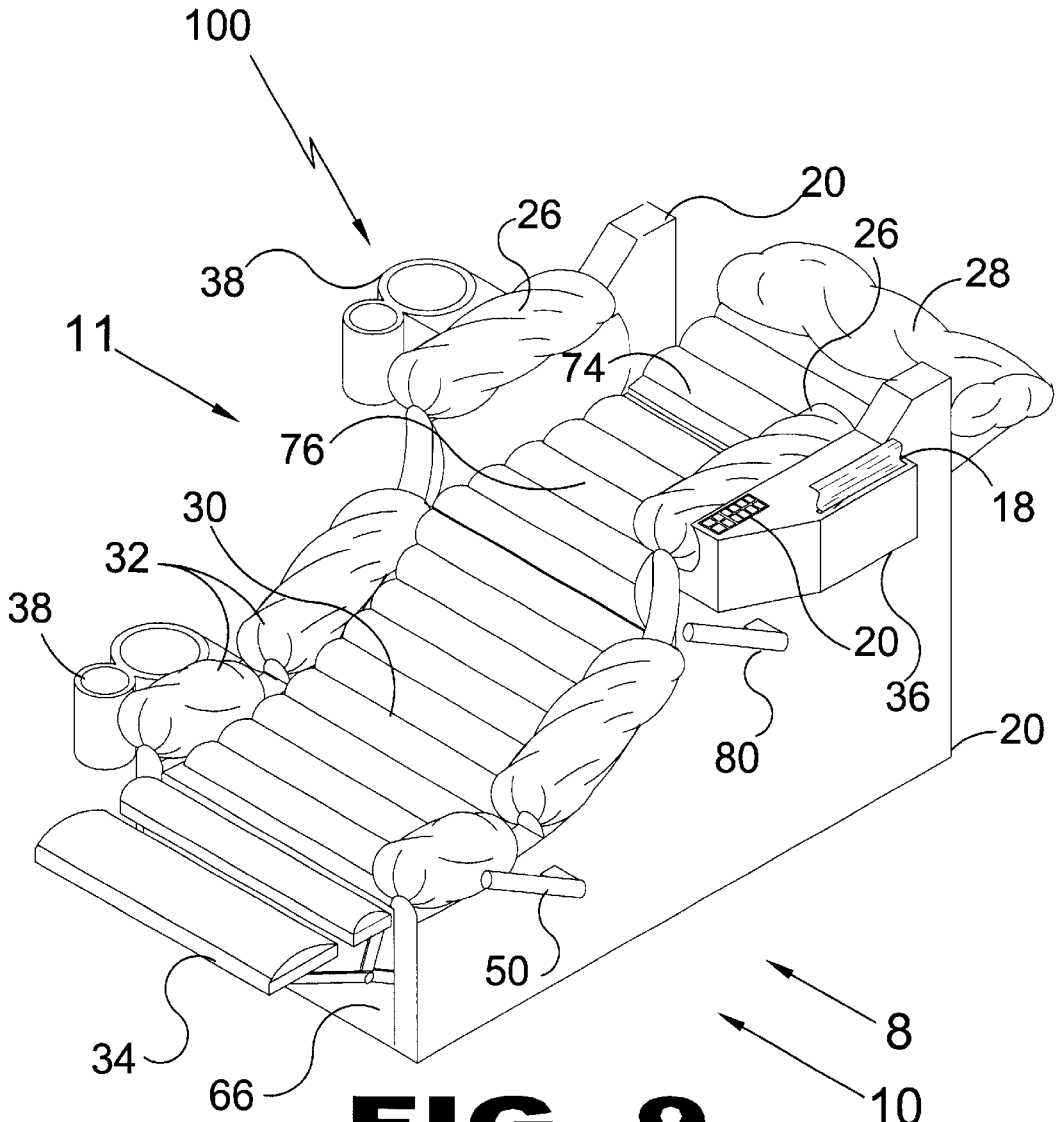

FIG. 9 is an isometric view of the present invention showing the present invention with the reclining backrest down and the pop up footrest out. Also shown is operating handle that controls the reclining backrest and pop up footrest.

Figure 10:
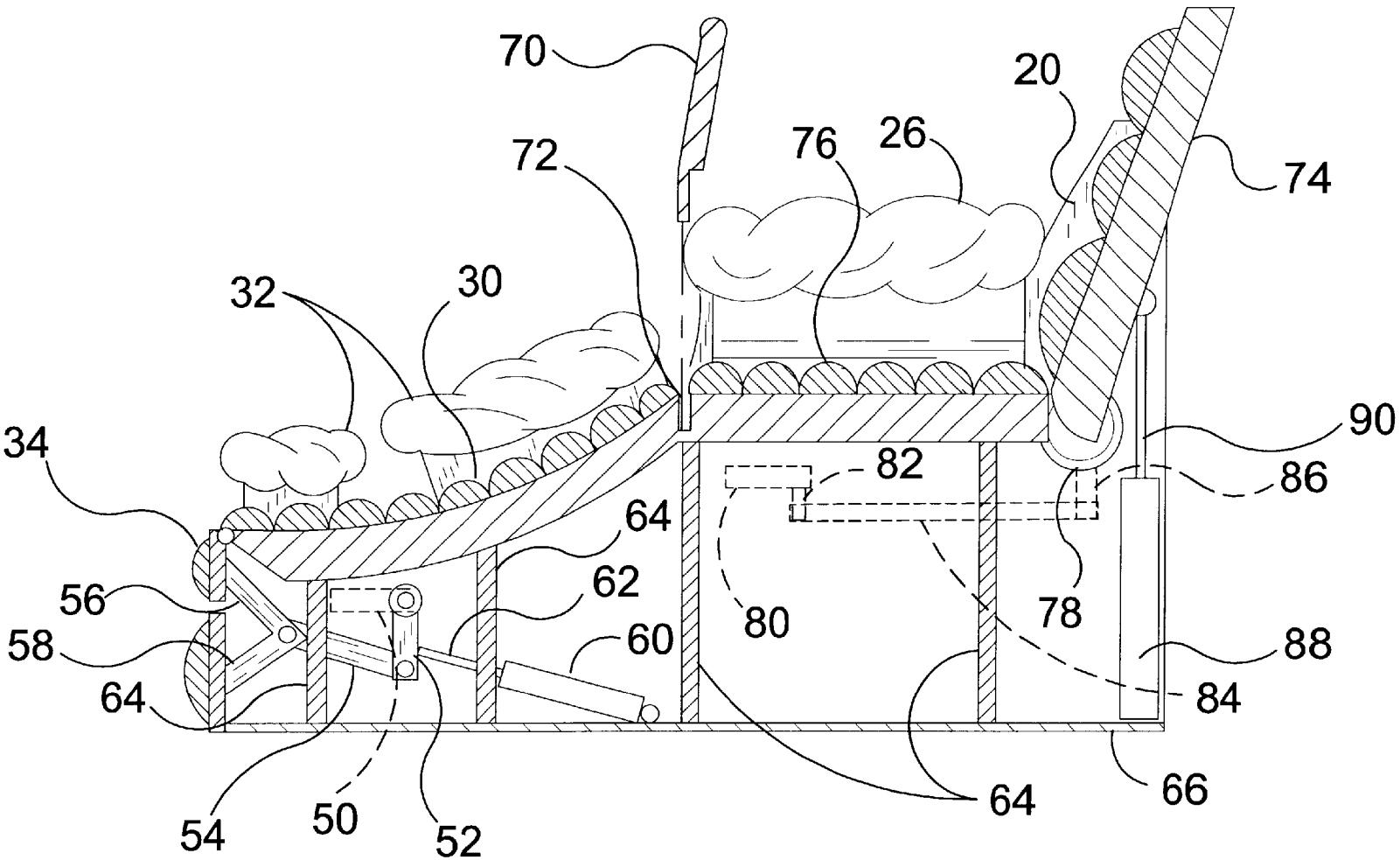

FIG. 10 is a sectional side view of the present invention showing one possible frame construction for the present invention having an extendable retractable footrest, selectively adjustable backrest and an optional backrest for the lower seat.

Figure 11:
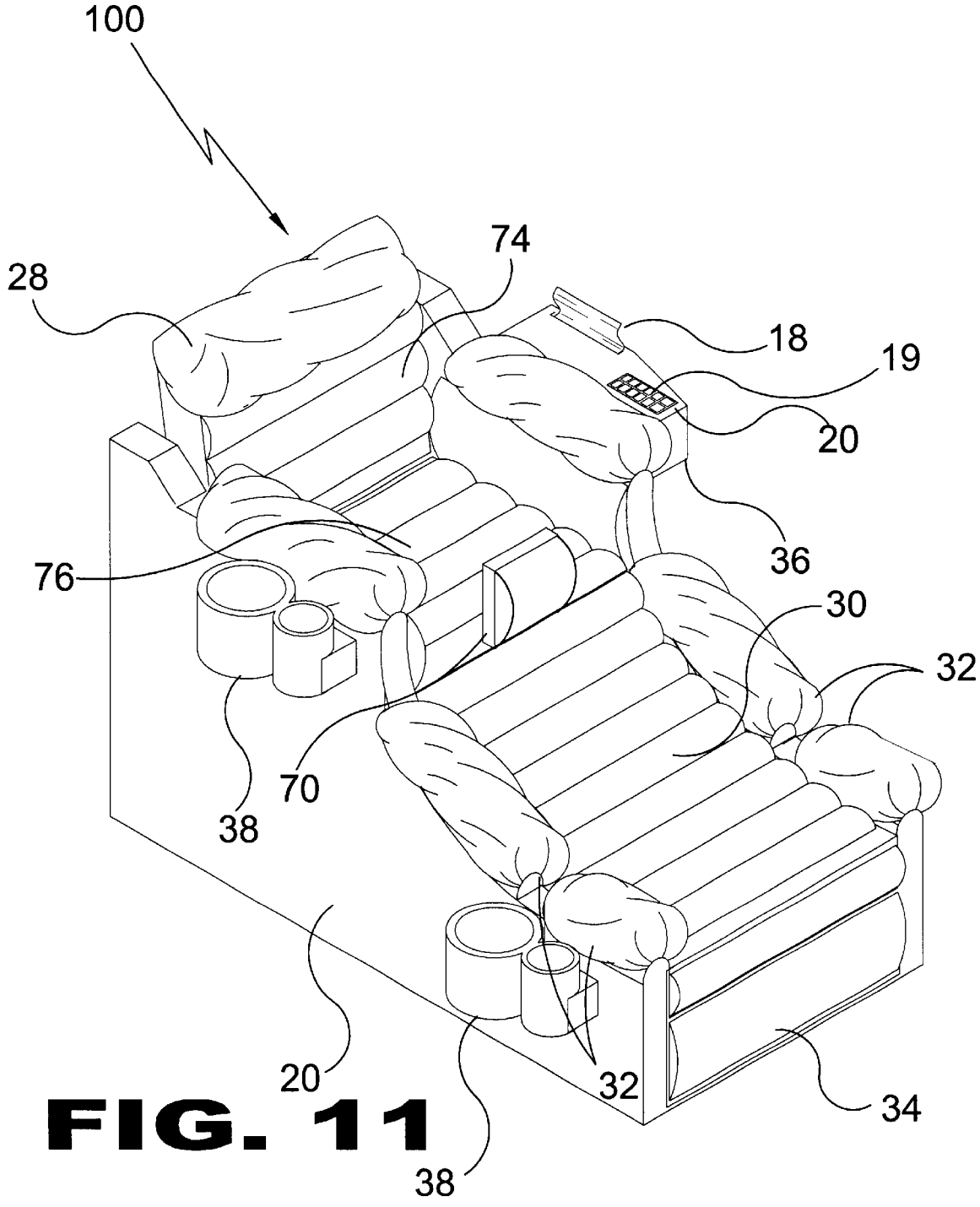

FIG. 11 is an isometric view of the present invention showing the present invention showing the installed optional backrest.

Figure 12:
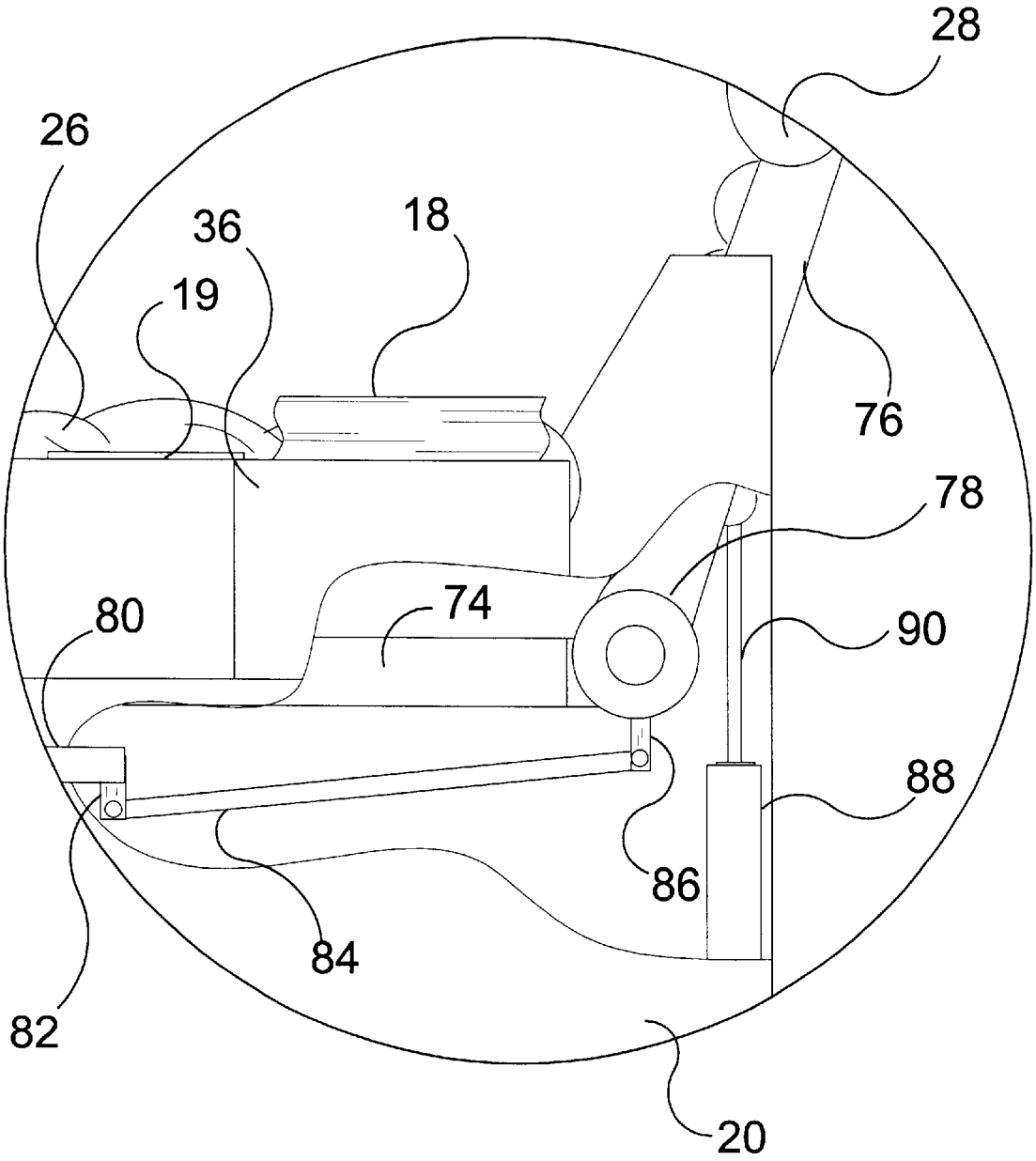

FIG. 12 is a cut away view of the present invention showing the internal components of the reclining backrest in the upright position.

Figure 13:
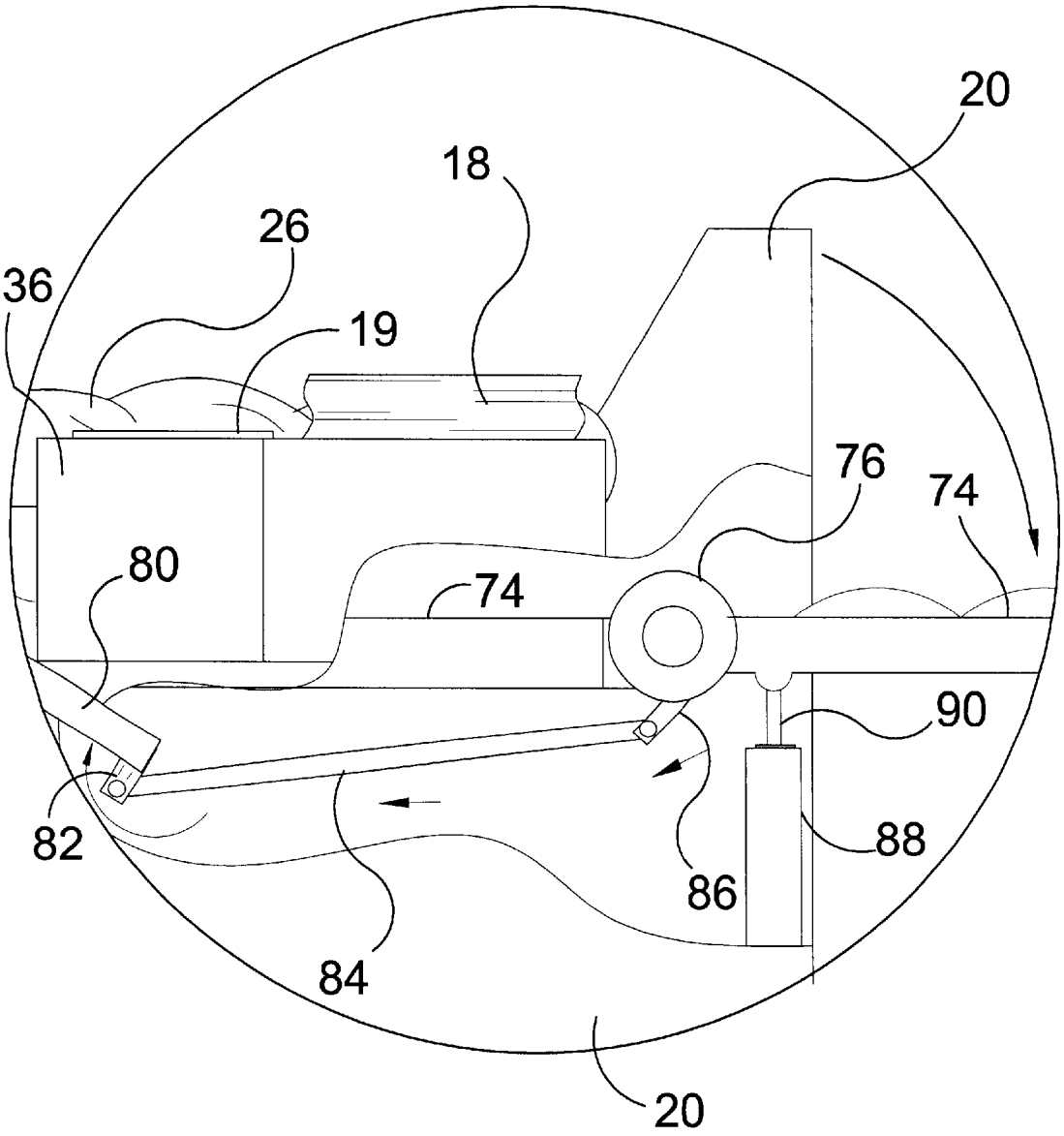

FIG. 13 is a cut away view of the present invention showing the internal components of the reclining backrest in the reclined position. Also shown are arrows to show the movements that the functional components make when transferring from the upright to the reclined position.

Figure 14:
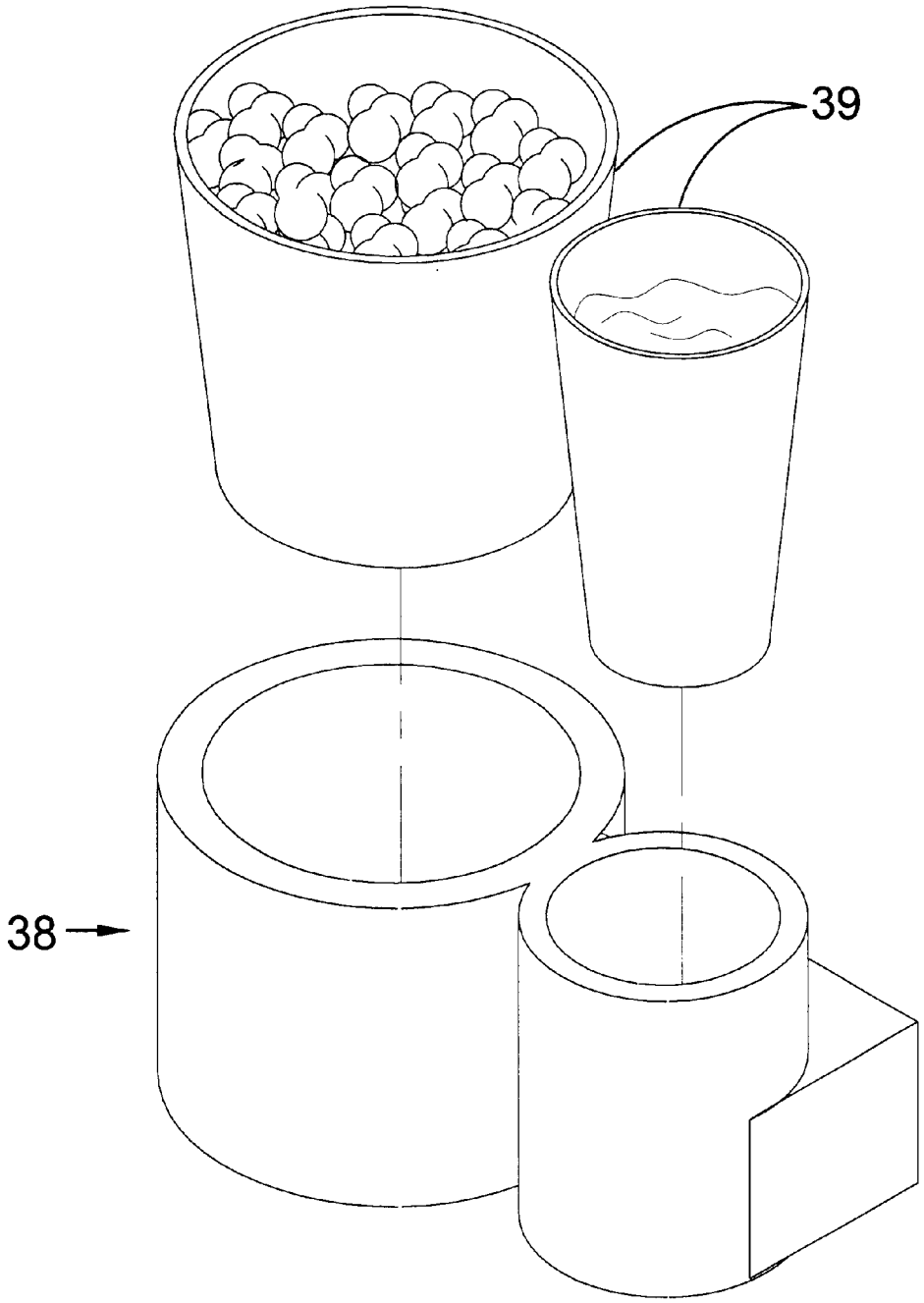

FIG. 14 is an isometric view of one of the food and beverage receptacles showing a popcorn container and beverage inserted therein.

DESCRIPTION OF THE REFERENCED NUMERALS

Turning now descriptively to the drawings, in which similar reference characters denote similar elements throughout the several views, the figures illustrate the Tandem Movie Lounge of the present invention. With regard to the reference numerals used, the following numbering is used throughout the various drawing figures.

| | |
|---|---|
| 10 | Tandem Movie Lounge of the present invention |
| 11 | first occupant |
| 12 | second occupant |
| 13 | first occupant's legs |
| 14 | first occupant's feet |
| 15 | second occupant's head |
| 16 | first occupant's waist area |
| 17 | second occupant's feet |
| 18 | paper towels |
| 20 | remote control |
| 20 | frame side panels |
| 22 | first seat |
| 24 | first seat backrest |
| 26 | first seat armrests |
| 28 | first seat headrest |
| 30 | second seat |
| 32 | second seat armrests |
| 34 | second seat footrest |
| 36 | paper towel dispenser |
| 38 | food and beverage holders |
| 39 | food and beverage |
| 40 | paper towel dispenser interior access door |
| 42 | paper towel dispenser interior access door magnets |
| 44 | paper towel dispenser slot |
| 46 | paper towel dispenser remote control cavity |
| 50 | footrest handle |
| 52 | footrest first link member |
| 54 | footrest second link member |
| 56 | footrest third link member |
| 58 | footrest fourth link member |
| 59 | footrest handle locking mechanism |

-continued

| | |
|---|---|
| 60 | footrest pneumatic lifter |
| 62 | footrest pneumatic lifter rod |
| 64 | seat support members |
| 66 | frame bottom panel |
| 70 | removable second seat backrest |
| 71 | removable second seat backrest insertion posts |
| 72 | removable second seat backrest insertion holes |
| 74 | reclining seat back |
| 76 | first seat |
| 78 | multi-position hinge assembly |
| 80 | seat back recliner handle |
| 82 | seat back recliner first link member |
| 84 | seat back recliner second link member |
| 86 | seat back recliner third link member |
| 88 | seat back recliner pneumatic lifter |
| 90 | seat back recliner pneumatic lifter rod |
| 100 | alternate embodiment |

DETAILED DESCRIPTION OF THE PREFERRED EMBODIMENTS

The following discussion describes in detail one embodiment of the invention and several variations of that embodiment. This discussion should not be construed, however, as limiting the invention to those particular embodiments. Practitioners skilled in the art will recognize numerous other embodiments as well. For a definition of the complete scope of the invention, the reader is directed to the appended claims.

Turning now descriptively to the drawings, in which similar reference characters denote similar elements throughout the several views, FIGS. 1–14 illustrate the Tandem Movie Lounge, and its individual features, the Tandem Movie Lounge indicated generally by the numeral 10, and an alternate embodiment by the numeral 100.

Figure 1:
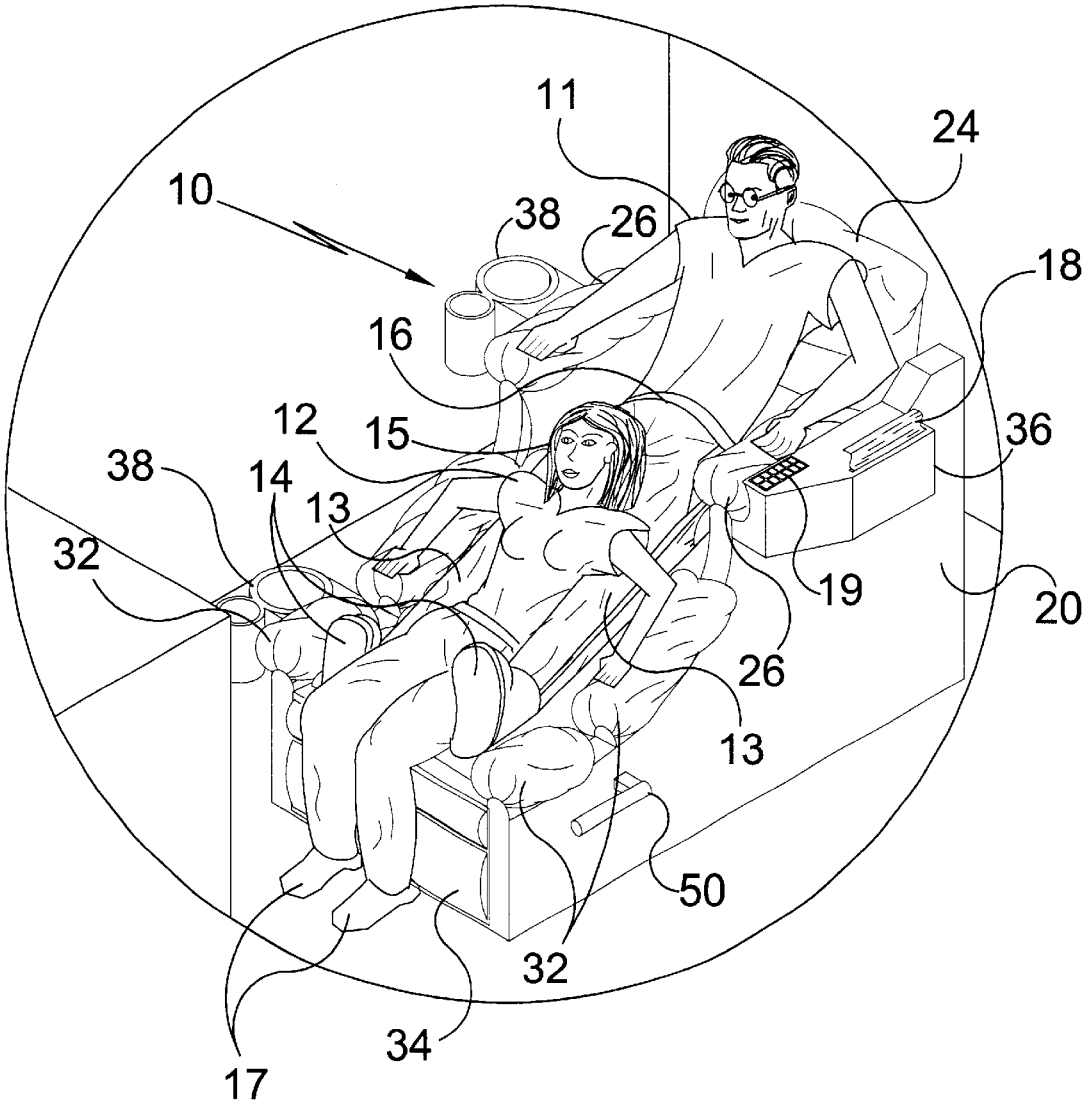
FIG. 1 is an isometric view of the present invention with two occupants seated in tandem.

The lounge 10 is in the form of a chair, and is shown in use by the first occupant 11 and second occupant 12 in FIG. 1, the occupants 11,12 seated in tandem for enhancement of the viewing experience.

Figure 2:
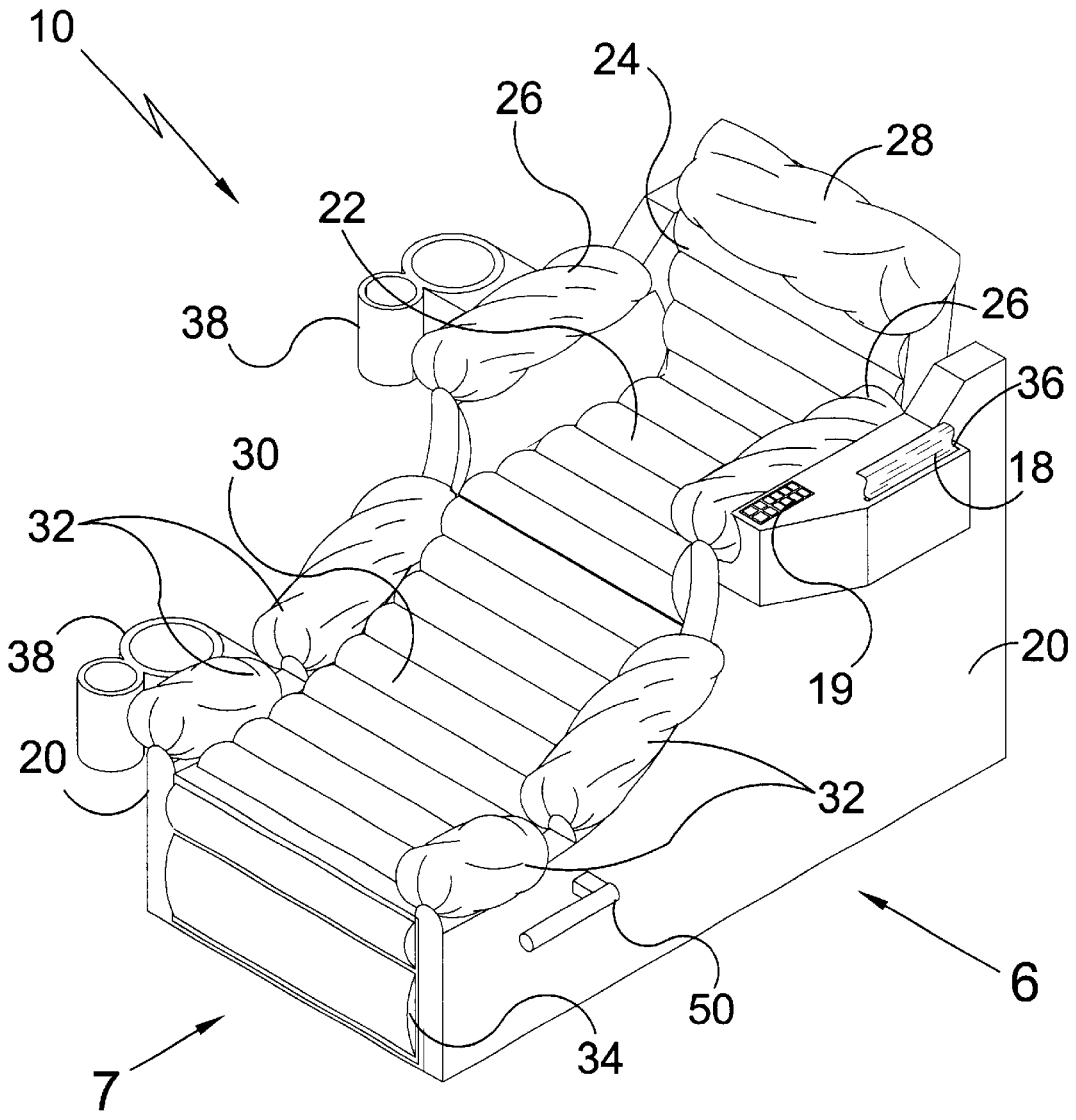
FIG. 2 is an isometric view of the present invention showing the present invention having both upper seating and lower seating to accommodate the seating of two people at a time.

FIGS. 1 and 2 depict the complete lounge 10, showing supporting frame side panels 20, first seat 22, first seat back 24, first seat armrests 26, first seat headrest 28, second seat 30, second seat armrests 32, and second seat footrest 34. In curvilinear fashion, the second seat 30 extends forwardly and downwardly from the front of the first seat 22, with a sufficient length to allow comfortable seating and reclining by the second occupant 12.

Figure 4:
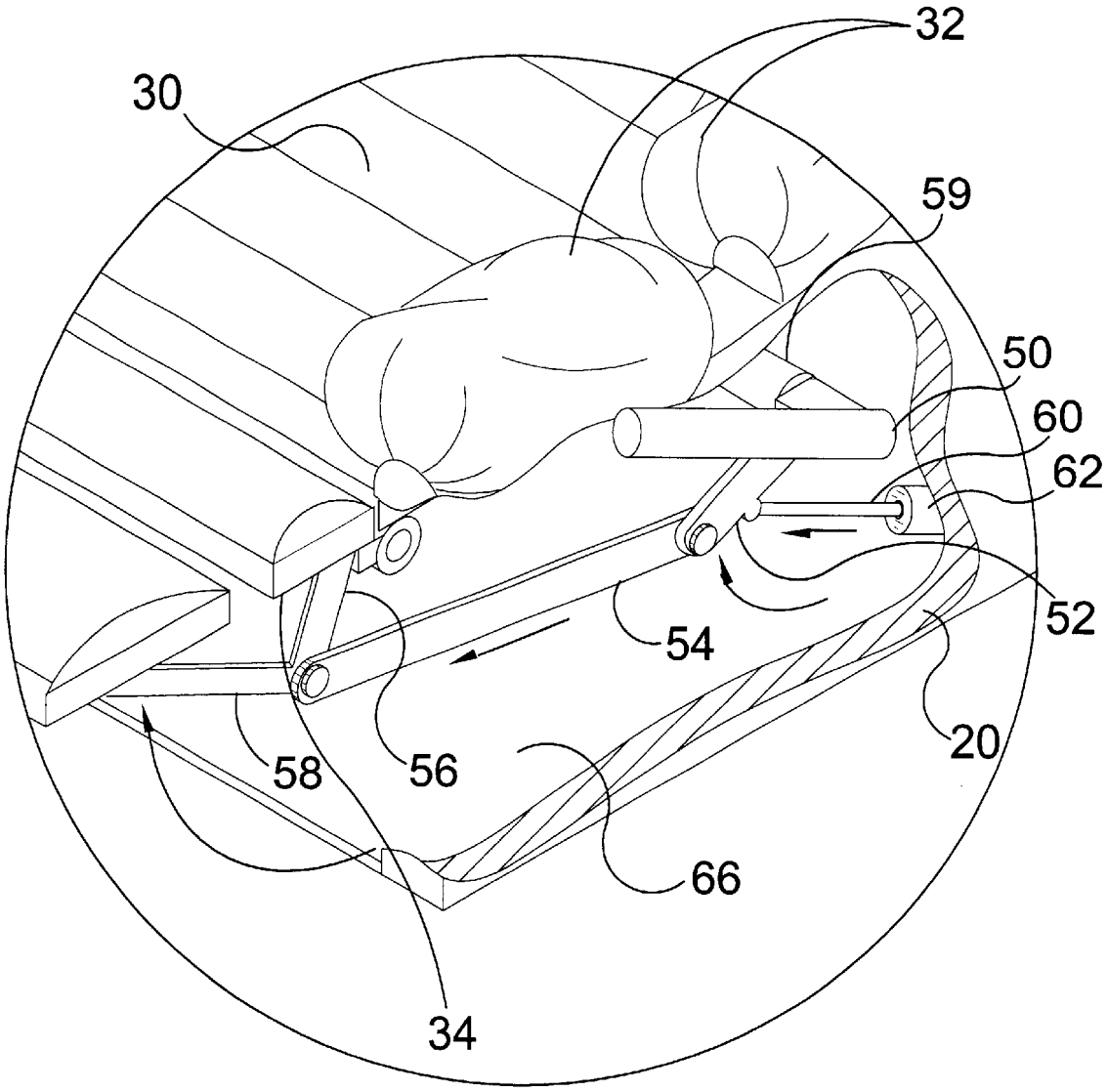
FIG. 4 is a cut away view of the present invention showing the internal components of the pop up footrest in the extended position. Also shown are arrows to indicate the movement of the pop up footrest's internal components when moving from the retracted position to the extended position.

When the two occupants 11,12 are properly seated, the first occupant's legs 13 encompass the second occupant 12, with the first occupant's feet 14 resting on the second seat 30. The second occupant 12 can sit vertically, or as shown in FIG. 1, can recline and rest her head 15 against the first occupant's waist area 16. In such a position the first occupant's legs 13 can serve as armrests for the second occupant 12. The second occupant's feet 17 are positioned for elevation by the footrest 34 when the footrest 34 is raised, as shown in FIG. 4.

User convenience features are also shown in FIGS. 1 and 2, including the paper towel dispenser 36 attached to the side panel 20 near the first seat armrest 26, and the food and beverage holders 38, attached near the first and second seat armrests 26,32.

Figure 5:
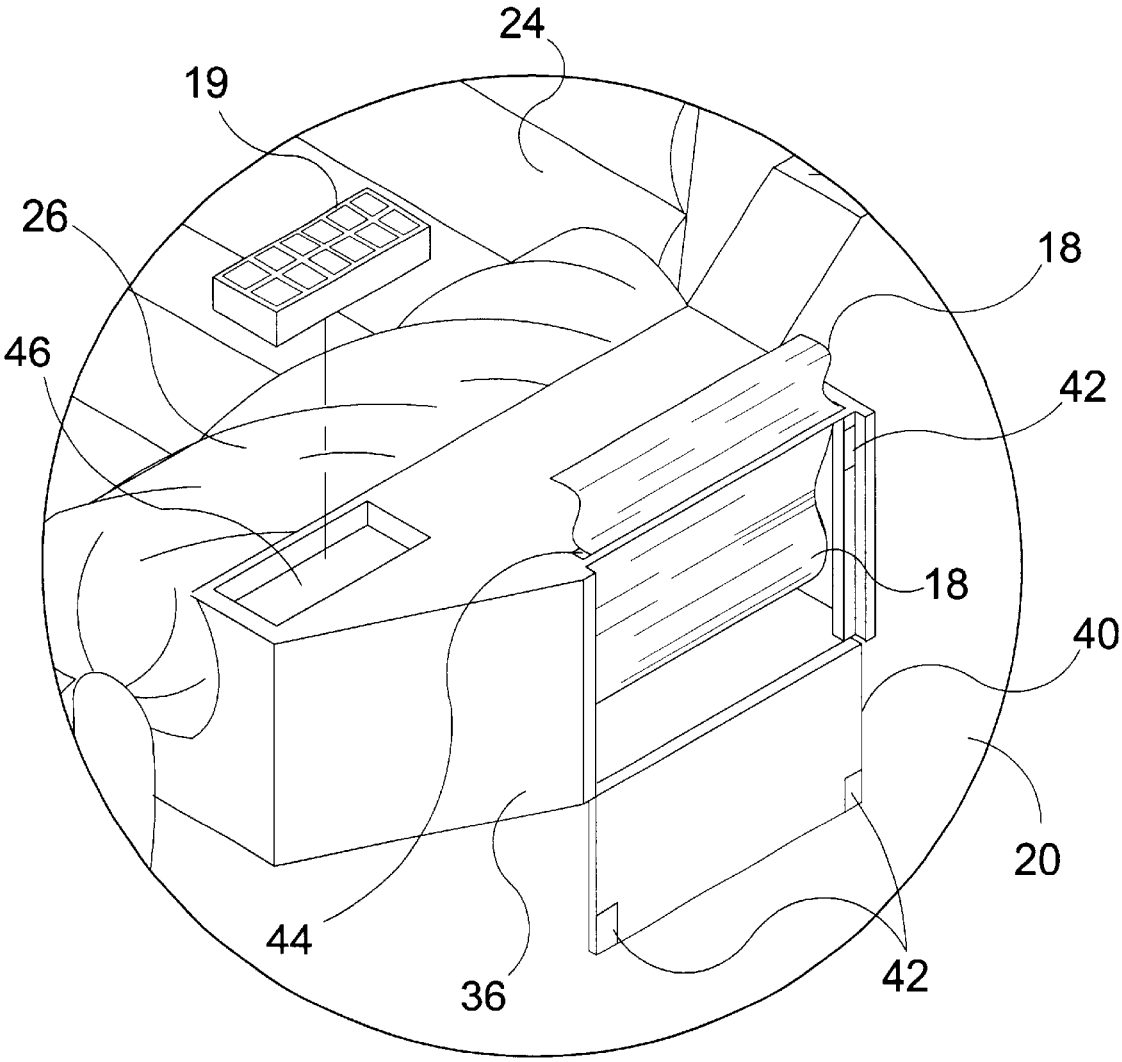
FIG. 5 is an isometric view of the present invention, showing the placement and relationships between the components of the paper towel dispenser. Also shown is a loading door in the open position so that additional paper towels may be placed inside if they run out, and so that miscellaneous items may be stored within the dispenser interior.

As shown in FIG. 5, the paper towel dispenser 36 includes a hinged door 40, held closed by magnets 42, that allows access to the dispenser interior for placement of a roll of paper towels 18. The leading towel 18 is fed through a slot 44 to provide hand access by the first and second occupants 11,12. A cavity 46 is provided in the paper towel dispenser 36 that is sized to receive a remote control 19. The cavity 46 can be varied in depth such that the remote control 19 can operate while in the cavity 46. The paper towel dispenser 36 is sized such that other items may be stored in the interior as well.

The dispenser 36, or one or more additional dispensers, can be located proximate any of the other armrests 26,32, and the food and beverage holders 38, or one or more additional holders, can be attached proximate any one or more of the other armrests 26,32, as desired by the users 11,12.

As shown in FIG. 14, food and beverage items 39, such as popcorn containers and drink cups, can be inserted into the food and beverage holders 38.

Figure 3:
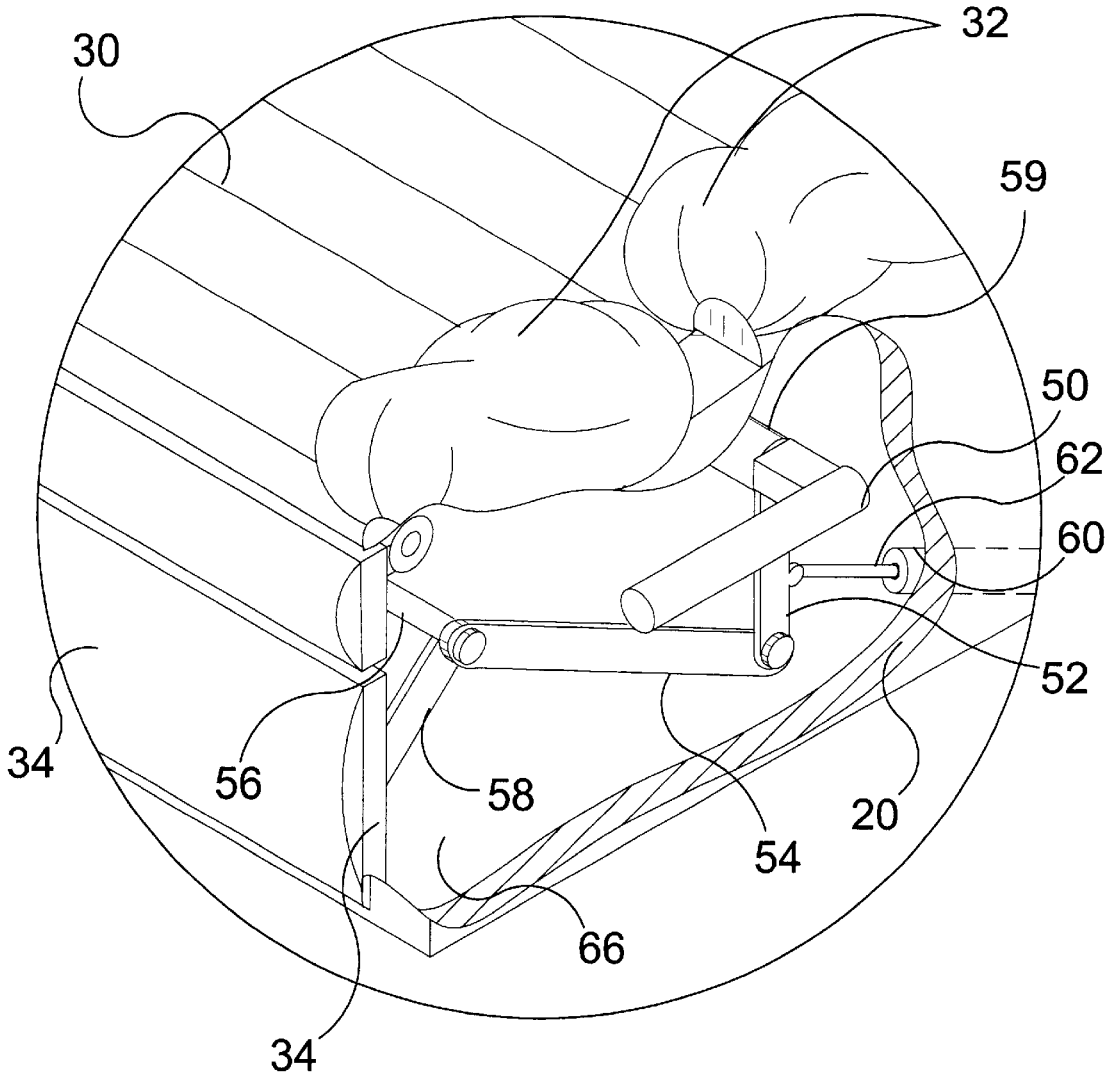
FIG. 3 is a cut away view of the present invention showing the internal components of the pop up footrest in the retracted position.

FIGS. 3 and 4 depict the means by which the footrest 34 is extended from its retracted position. A handle 50 is positioned outside the frame side panel 20 and extends through the side panel 20 wherein the handle 50 is attached to a first link member 52. The first link member 52 is linked to a second link member 54 that is in turn linked to a third and fourth link member 56,58, of different lengths. The third and fourth link members 56,58 are attached to the footrest 34. A hydraulic lift assembly, in this case a pneumatic lifter 60, has a rod 62 hingedly attached to the first link member 52, such that the first link member 52 is pushed by the rod 62 as the rod 62 moves from the pneumatic lifter 60.

As shown in FIG. 4, the rotation of the handle 50 rotates first link member 52, with the assistance of the pneumatic lifter 60. The rotation of first link member 52 causes second link member 54 to force the third link member 56 against the top of the footrest 34 and the longer fourth member 58 against the bottom of the footrest 58, the difference in length allowing the footrest 34 to pivot into an extended, generally horizontal position. As part of this linkage assembly, the handle 50 can be secured by locking mechanism 59.

Figure 6:
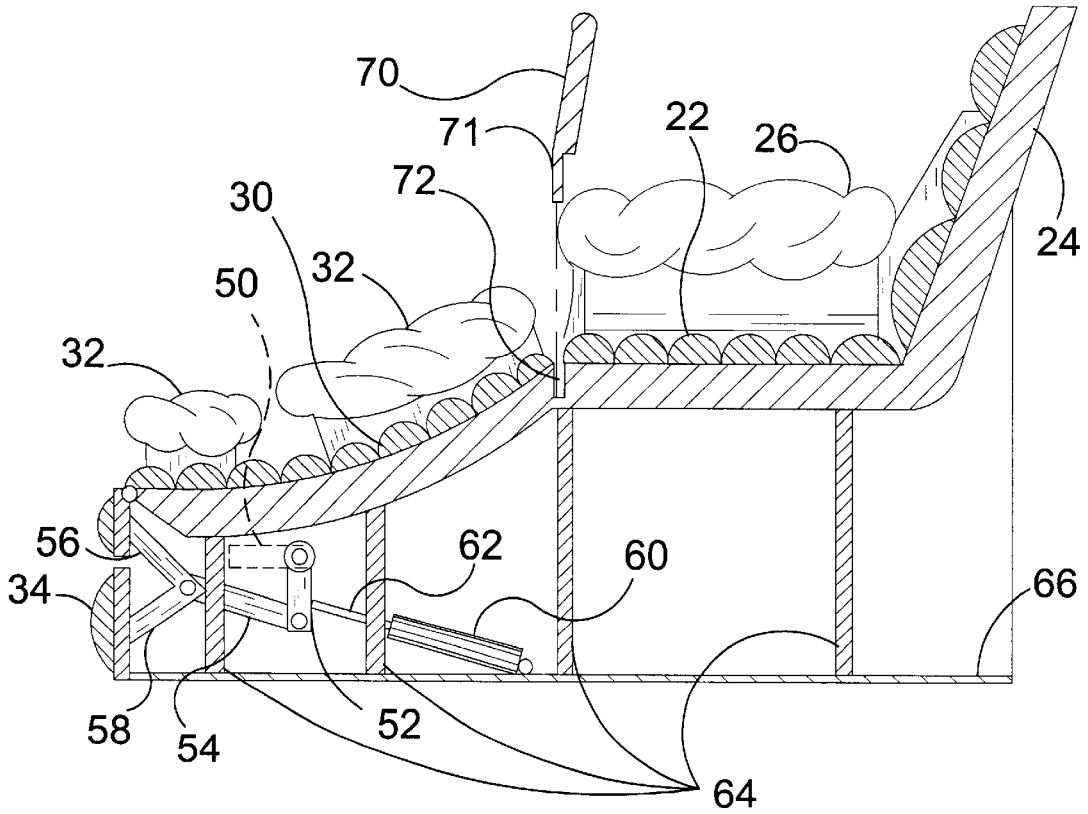
FIG. 6 is a sectional side view of the present invention showing one possible frame construction for the present invention having an extendable retractable footrest and an optional backrest for the lower seat.
Figure 7:
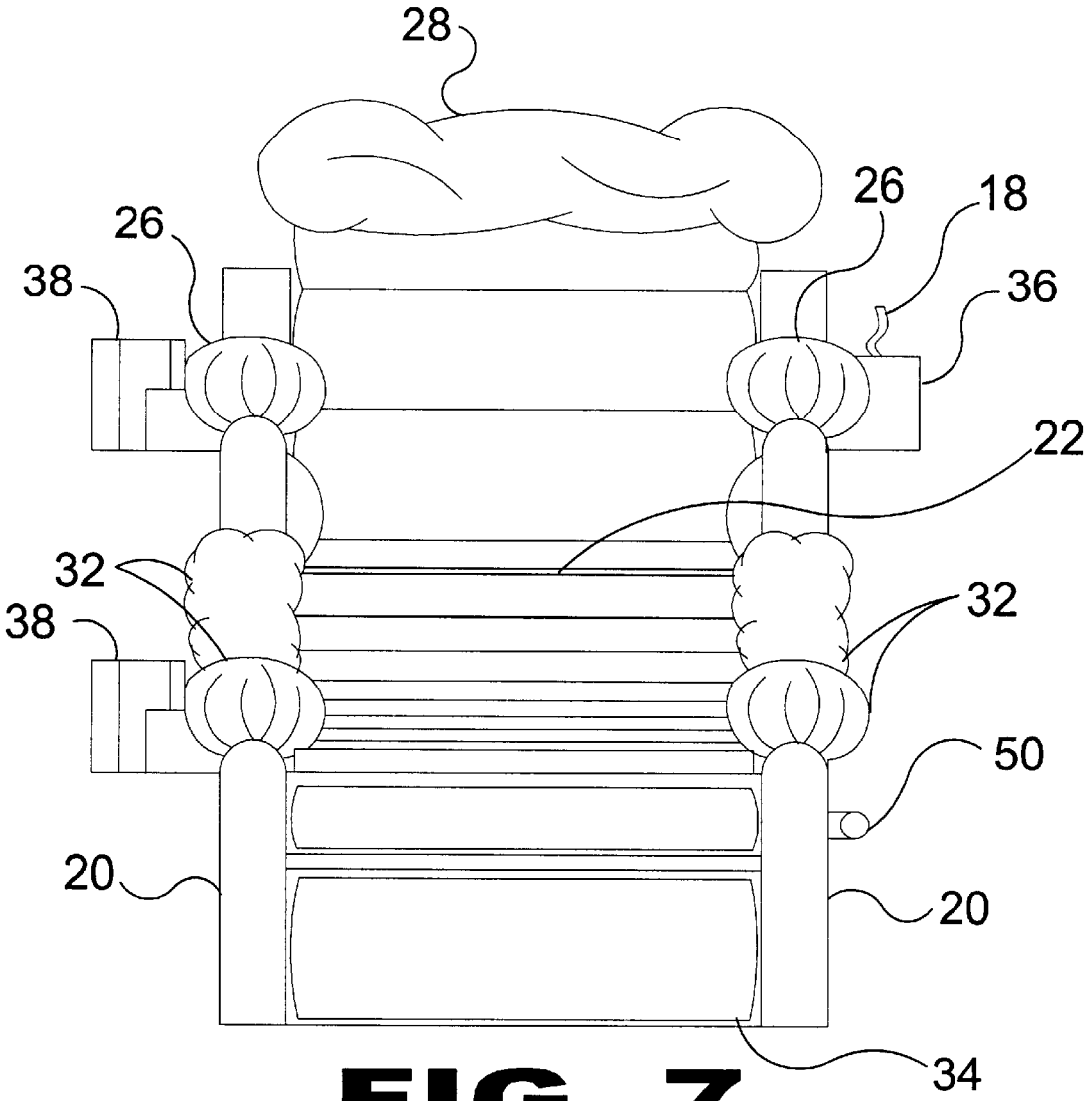
FIG. 7 is a front view of the present invention.
Figure 8:
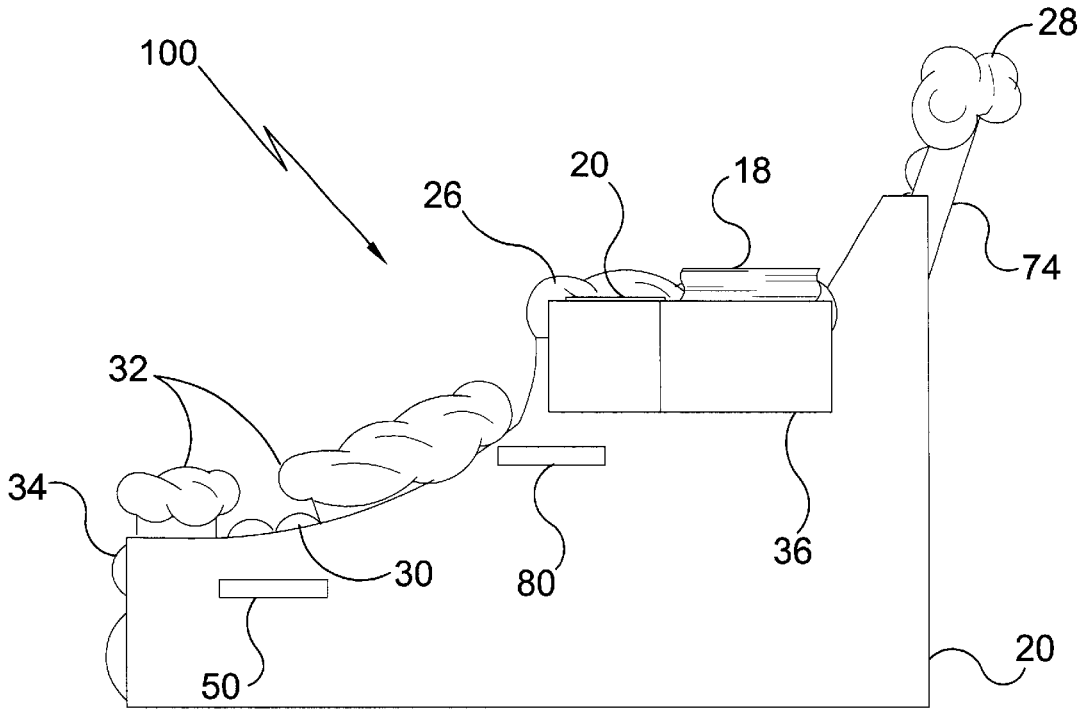
FIG. 8 is a side view of an alternate embodiment having an additional element in the form of a reclining backrest.

As shown in FIG. 6, both the first seat 22 and the second seat 30 are independently supported by support members 64 that extend to a frame bottom panel 66. The pneumatic lifter 60 is attached at one end to the frame bottom panel 66. The support members 64 are positioned such that the second seat 30 can be occupied without a first seat 22 occupant.

Also shown in FIG. 6 is a removable second seat backrest 70, having posts 71 that are secured within holes 72 formed between first seat 22 and second seat 30. As shown in FIG. 11, the second seat backrest 70 is sized such that the first occupant's legs 13 can comfortably extend around the backrest 70, with his feet 14 remaining on the second seat 30. When the second seat 30 is being used to the exclusion of the first seat 22, a larger removable backrest can be used.

To this point the lounge 10 has included a fixed first seat back 24. FIGS. 8–13 depict an alternate embodiment 100 that includes a reclining seat back 74. This first seat back 74 is hingedly attached to the separate first seat 76 using a multi-position hinge assembly 78. The hinge assembly 78 is locked into one position while a handle 80 is in a first position, as shown in FIGS. 10 and 12. The handle 80 is positioned outside the frame side panel 20 and extends through the side panel 20 where it is connected to a first link member 82. The first link member 82 is attached to a second link member 84, that is in turn connected to a third link member 86. The third link member 86 extends within the hinge assembly 78 wherein it engages the hinge assembly 78 such that the seat back 74 is fixed while the handle 80 is in the first position. Another hydraulic lift device, in this case a second pneumatic lifter 88, is positioned such that its rod 90 is hingedly attached to the seat back 74. As the rod 90 extends outwardly the seat back 74 is urged to the upright position, as shown in FIGS. 12 and 13.

Rotation of the handle 80 to the second position, as shown in FIG. 13, rotates the first link member 82, causing the first link member 82 to pull the second link member 84. This causes the third link member 86 to release the hinge assembly 78 for seat back 74 rotation. When the desired seat back 74 angle is achieved the handle 80 is moved back to the first position and the hinge assembly 78 is once again locked against further movement.

To bring the seat back 74 to a more upright position, the handle 80 is again rotated to the second position. The released hinge assembly 78 will allow the pneumatic lifter 88 to rotate the seat back 74 to a more vertical angle until the handle 80 is rotated back to the first position.

The lounge 10 and its foregoing components can be constructed using various materials, including various woods, metals and plastics for the supporting structure 20,64,66, various fabrics and cushioning materials for the seating 22,30,76, armrests 26,32, backrests 32,70,74, footrests 34, and headrest 28, and various woods, metals and plastics for the food and beverage holders 38 and paper towel dispenser 36. The materials, in various component combinations can be sized to accommodate users of various sizes.

In another embodiment the chair is separable into two portions for independent use, one portion including the first seat 22, the other portion including the second seat 30,76.

With respect to the above description then, it is to be realized that the optimum material and dimensional relationships for the parts of the chair, to include variations is size, materials, shape, and form, will occur to those skilled in the art upon review of the present disclosure, and all equivalent relationships to those illustrated in the drawings and described in the specification are intended to be encompassed by the present invention.

What is claimed as new and desired to be protected by Letters Patent is set forth in the appended claims:

1. A chair for two occupants in tandem, comprising:

a first seat assembly having:

a seat portion having a front edge;

a structure independently supporting the seat portion; and a seat back portion; and a second seat assembly having:

a curved seat portion extending downwardly and forwardly from and attached to the first seat assembly seat portion front portion, the curved seat portion having a front portion;

a curved seat portion supporting structure independently supporting the curved seat portion; and a footrest extending from and pivotally connected to the curved seat portion front portion, the footrest being movable between a first position that is substantially vertical and a second position that is substantially horizontal.

2. The chair of claim 1, further comprising a handle and linkage, the linkage being attached to the handle and the footrest, such that movement of the handle in a first direction forces the footrest from its first to its second position, and movement of the handle in a second direction forces the footrest from its second to its first position.

3. The chair of claim 2, further comprising a hydraulic lift assembly attached to the footrest linkage such that the movement of the footrest from the first position to the second position is assisted.

4. The chair of claim 1, wherein the seat back portion is reclinable relative to and pivotally connected to the first seat portion.

5. The chair of claim 1, wherein the first seat assembly seat back portion is hingedly attached to the first seat assembly seat portion.

6. The chair of claim 1, further comprising a multi-position hinge assembly for hingedly attaching the first seat assembly seat back portion to the first seat assembly seat portion, such that the seat back portion may be positioned at varying angles to the front seat assembly seat portion.

7. The chair of claim 6, further comprising a handle and linkage, the linkage being attached to the handle and the multi-position recliner assembly, such that movement of the handle in a first direction releases the multi-position recliner assembly for adjustment, and movement of the handle in a second direction locks the multi-position recliner assembly, preventing additional adjustment.

8. The chair of claim 7, further comprising a hydraulic lift assembly attached to the seat back portion such that the movement of the seat back portion to a more vertical position is assisted.

9. The chair of claim 1, wherein the second seat assembly further comprises a removable backrest, the backrest being attachable proximate the first seat assembly seat portion front portion.

10. The chair of claim 9, wherein the removable backrest is sized for positioning between the legs of the occupant seated on the first seat assembly seat portion, the occupant's feet remaining on the second seat assembly curved portion.

11. The chair of claim 1, wherein the first seat assembly further comprises at least one armrest.

12. The chair of claim 11, further comprising a paper towel dispenser attached proximate the armrest.

13. The chair of claim 12, wherein the paper towel dispenser further comprises a cavity for storage of an electronic remote control unit.

14. The chair of claim 12, wherein the paper towel dispenser has an interior, a door for inserting the paper towel roll into the paper towel dispenser interior, and a slot for feeding the paper towels from the paper towel dispenser interior.

15. The chair of claim 11, further comprising a food receptacle attached proximate the armrest.

16. The chair of claim 11, further comprising a drink receptacle attached proximate the armrest.

17. The chair of claim 11, further comprising a food and drink receptacle attached proximate the armrest.

18. The chair of claim 1, wherein the second seat assembly further comprises at least one armrest.

19. The chair of claim 18, further comprising a paper towel dispenser attached proximate the armrest.

20. The chair of claim 19, wherein the paper towel dispenser further comprises a cavity for storage of an electronic remote control unit.

21. The chair of claim 19, wherein the paper towel dispenser has an interior, a door for inserting the paper towel roll into the paper towel dispenser interior, and a slot for feeding the paper towels from the paper towel dispenser interior.

22. The chair of claim 18, further comprising a food receptacle attached proximate the armrest.

23. The chair of claim 18, further comprising a drink receptacle attached proximate the armrest.

24. The chair of claim 18, further comprising a food and drink receptacle attached proximate the armrest.

25. The chair of claim 1, wherein the first seat assembly and second seat assembly may be separated and rejoined.

26. A chair for two occupants in tandem, comprising:

means for seating the first occupant having a first seat; and means for seating the second occupant having a second seat including means for supporting the second occupant's feet, said means for supporting the second occupant's feet including an extendable and retractable footrest;

said means for seating a first occupant including means for supporting the seated first occupant when the second seat is unoccupied, and said means for seating a second occupant including means for supporting the seated second occupant when the first seat is unoccupied.

27. The chair of claim 26, wherein the means for seating the second occupant further comprises means for supporting the back and head of the second occupant and which is removably attached.

28. The chair of claim 26, further comprising means for holding food and beverages.

29.The chair of claim 26, further comprising means for accessing and storing paper towels.

30. The chair of claim 26, further comprising means for accessing and storing an electronic remote control.

31. The chair of claim 26, wherein the means for seating the first occupant further comprises a seat back and means for adjusting the seat back angle relative to the first seat.

* * * * *